US012510324B2

(12) United States Patent
Pisor et al.

(10) Patent No.: US 12,510,324 B2
(45) Date of Patent: Dec. 30, 2025

(54) PROJECTILE LAUNCHER

(71) Applicant: H.P. Shelby Manufacturing Ltd., Chicago, IL (US)

(72) Inventors: Henry Pisor, Chicago, IL (US); David Pisor, Chicago, IL (US)

(73) Assignee: H.P. Shelby Manufacturing Ltd., Chicago, IL (US)

( * ) Notice: Subject to any disclaimer, the term of this patent is extended or adjusted under 35 U.S.C. 154(b) by 233 days.

(21) Appl. No.: 18/269,929

(22) PCT Filed: Dec. 28, 2021

(86) PCT No.: PCT/US2021/065385

§ 371 (c)(1),
(2) Date: Jun. 27, 2023

(87) PCT Pub. No.: WO2022/147038

PCT Pub. Date: Jul. 7, 2022

(65) Prior Publication Data

US 2024/0085139 A1 Mar. 14, 2024

Related U.S. Application Data

(60) Provisional application No. 63/130,947, filed on Dec. 28, 2020.

(51) Int. Cl.

| | |
|---|---|
| ***F41B 4/00*** | (2006.01) |
| ***F41B 7/08*** | (2006.01) |
| *F42B 6/00* | (2006.01) |

(52) U.S. Cl.
CPC . *F41B 4/00* (2013.01); *F42B 6/00* (2013.01)

(58) Field of Classification Search
CPC ... A63H 33/00; F41B 4/00; F41B 7/08; F41B 11/55; F41B 9/68; F42B 6/00
USPC ..... 124/1, 6, 46, 51.1, 78, 81; 446/473
See application file for complete search history.

(56) References Cited

U.S. PATENT DOCUMENTS

| | | | | |
|---|---|---|---|---|
| 3,717,136 A * | 2/1973 | Gay et al. | F41B 7/08 | 473/588 |
| 5,050,575 A * | 9/1991 | Killion | F41B 7/08 | 124/8 |
| 5,396,876 A * | 3/1995 | Liscio | A63B 69/406 | 124/78 |
| 5,471,967 A * | 12/1995 | Matsuzaki | F41B 4/00 | 124/78 |
| 5,782,228 A * | 7/1998 | Wu | F41B 4/00 | 124/6 |

(Continued)

FOREIGN PATENT DOCUMENTS

CN 108888936 A 11/2018

OTHER PUBLICATIONS

International Preliminary Report on Patentability issued for PCT No. PCT/US2021/065385; issued Jul. 4, 2023.

(Continued)

*Primary Examiner* — Alexander R Niconovich
(74) *Attorney, Agent, or Firm* — Flener IP & Business Law

(57) ABSTRACT

A projectile launcher comprises a motor driven flywheel having a rotational axis and a roughened circumferential edge surface, and a flywheel housing having a passageway therethrough. The passageway comprises an entry opening at a first end that is configured to receive at least one disc projectile, and a release opening at a second end.

20 Claims, 16 Drawing Sheets

(56) References Cited

U.S. PATENT DOCUMENTS 5,947,101 A * 9/1999 Kerr ..... F41B 4/00 124/78
5,996,564 A * 12/1999 Kotowski ..... F41B 4/00 124/6
6,024,078 A * 2/2000 Hollis ..... F41B 4/00 124/78
6,116,229 A * 9/2000 Wu ..... F41B 4/00 124/6
6,915,793 B2 * 7/2005 Vanek ..... F41B 4/00 124/78
7,051,727 B2 * 5/2006 Wu ..... F41B 4/00 124/6
7,673,624 B2 * 3/2010 Rosella, Jr. ..... F41B 7/08 124/16
8,707,942 B2 * 4/2014 Lu ..... A63B 69/406 124/78
8,800,541 B2 * 8/2014 Hu ..... F41A 33/06 124/66
8,955,503 B2 * 2/2015 Corsiglia ..... A63B 69/406 124/78
8,997,727 B1 * 4/2015 Hamel ..... A63H 33/18 124/16
9,021,731 B2 * 5/2015 Macy ..... F41A 9/68 89/33.04
9,189,908 B2 * 11/2015 Sampson ..... B65H 3/56
9,914,041 B2 * 3/2018 Vorozilchak ..... A63B 69/0026
10,330,430 B2 * 6/2019 Kang ..... F41B 11/71
11,015,896 B1 * 5/2021 Hochberg ..... A63B 69/406
11,346,624 B2 * 5/2022 DeRoche ..... F41A 9/02
11,852,438 B2 * 12/2023 Hedeen, Jr. ..... F41B 4/00
2006/0231083 A1 * 10/2006 Tsurumoto ..... F41B 11/71 124/66
2016/0361620 A1 * 12/2016 Vorozilchak ..... A63B 69/0026
2021/0102769 A1 4/2021 DeRoche et al.

OTHER PUBLICATIONS

International Search Report for PCT No. PCT/US2021/065385; issued Mar. 23, 2022.

* cited by examiner

PROJECTILE LAUNCHER

CROSS-REFERENCE TO RELATED APPLICATIONS

This application claims priority to U.S. Provisional Application Ser. No. 63/130,947, filed on Dec. 28, 2020, which is incorporated by reference herein in its entirety.

FIELD OF THE INVENTION

The present invention relates to a projectile launcher. More specifically, the present invention relates to a toy projectile launcher that launches disc projectiles.

BACKGROUND

Toy projectile launchers are known in the art. However, existing toy projectile launchers lack particularly good accuracy or precision when fired at a target. Existing toy projectile launchers also lack a high rate of fire or a selector switch that allows a user to select between a single shot at a time or an automatic firing mode. A need exists for an entirely new toy projectile launcher including features never before included in such a projectile launcher, wherein the new features provide for a higher level of accuracy and precision and a high fire rate, as well as quick and easy bulk reloading, an increased ammunition capacity, and other features as are described more fully hereinbelow, all of which are directed toward an enhanced user experience.

BRIEF DESCRIPTION OF THE DRAWINGS

Other aspects and advantages of the present invention will become apparent upon consideration of the following detailed description, wherein similar structures have similar reference numerals.

DETAILED DESCRIPTION

The following detailed embodiments presented herein are for illustrative purposes. That is, these detailed embodiments are intended to be exemplary of the present invention for the purposes of providing and aiding a person skilled in the pertinent art to readily understand how to make and use of the present invention.

Figure 1A:
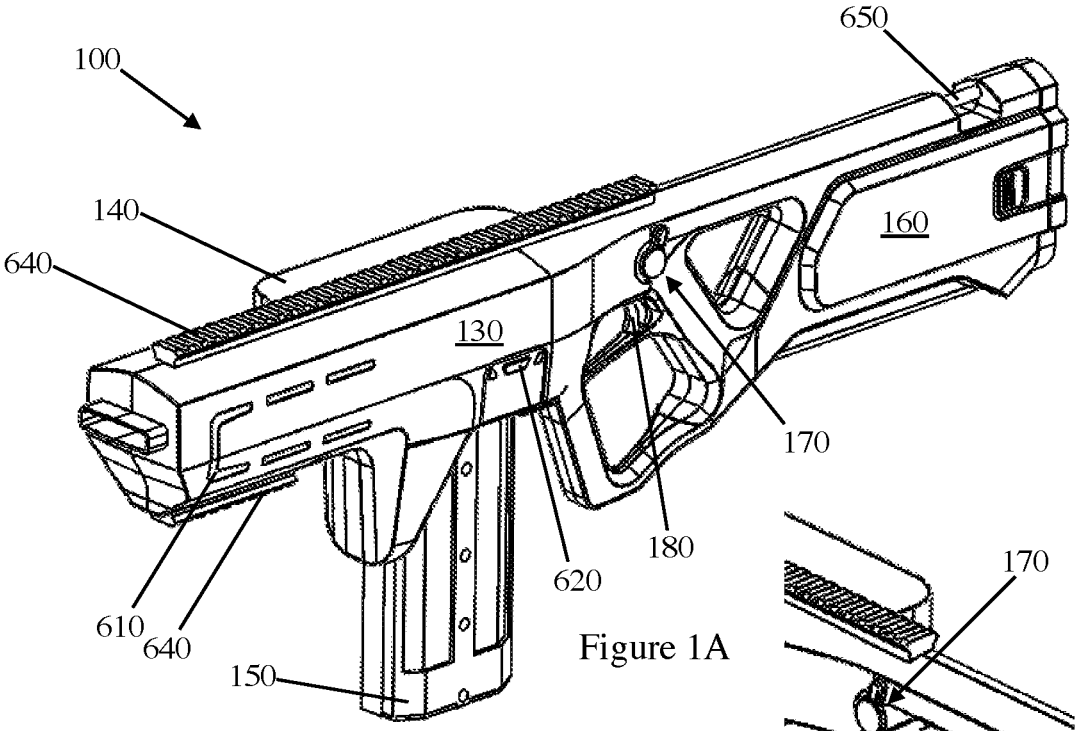
FIG. 1A is a left side perspective view of an exemplary embodiment of a projectile launcher.
Figure 1C:
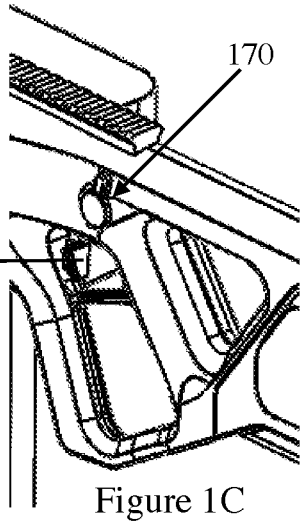
FIG. 1C is a close-up left side perspective view of the projectile launcher of FIG. 1A showing an exemplary location for a magazine release button.
Figure 1B:
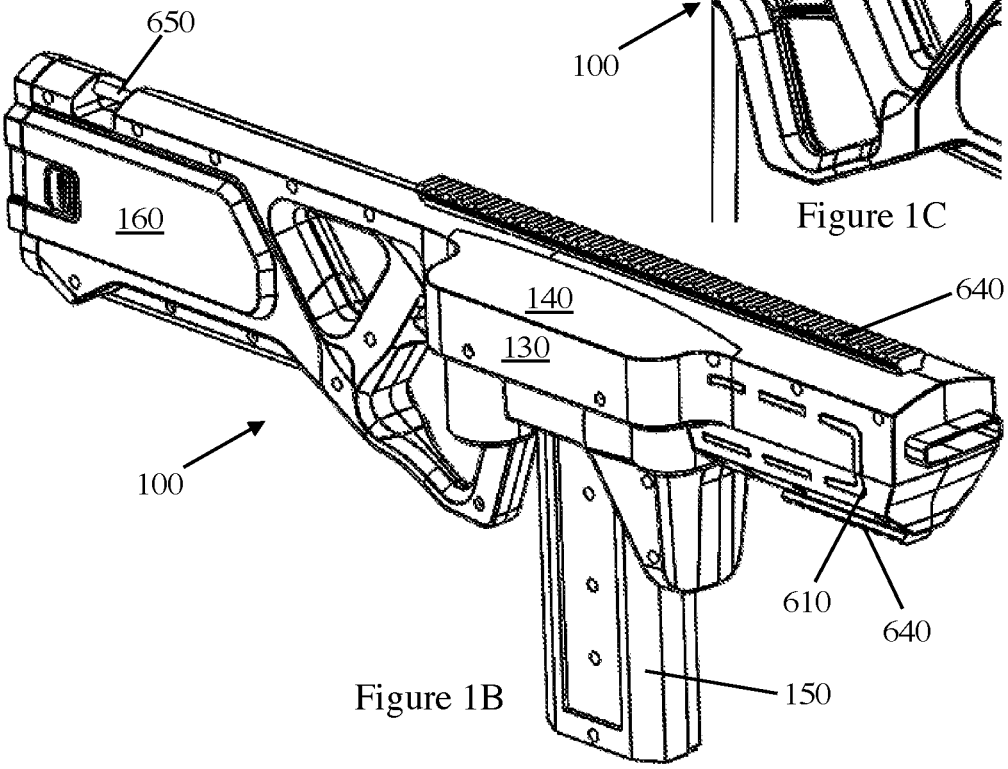
FIG. 1B is a right side perspective view of the exemplary embodiment of the projectile launcher.

Referring to FIGS. 1A and 1B, an exemplary embodiment of a toy projectile launcher 100 is illustrated in perspective views from the left and right sides, respectively. In one embodiment the launcher 100 is made from a plastic material as is known in the art. In other embodiments the launcher can be made at least in part from other or additional materials including metals or natural materials such as wood or other plant or fiber products. The toy launcher 100 or any portion of it disclosed herein can be made in any color as desired for aesthetics or identification of the launcher as part of a group of launchers or users thereof. In one embodiment the launcher has, for example without limitation, an overall length of about 28.3 inches, a width of about 4.25 inches, a height without a magazine 150 installed of about 6.88 inches, and a height with the magazine 150 installed of about 10.93 inches. In other embodiments the launcher can have other dimensions as desired or as otherwise known in the art. In one embodiment the launcher 100 weighs about 4.8 lbs.; however, in other embodiments the launcher 100 can weigh more or less than about 4.8 lbs.

Figure 2A:
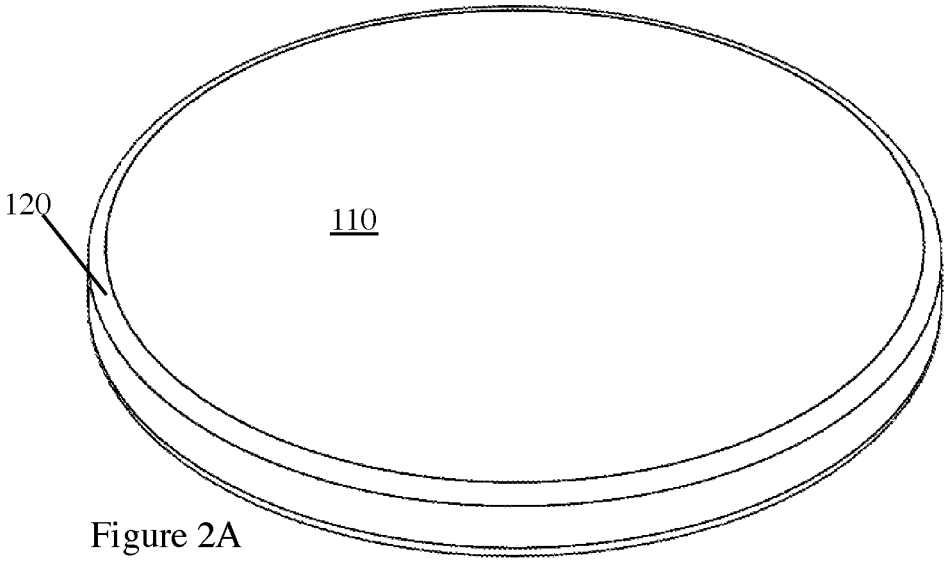
FIG. 2A is a top side perspective view of an exemplary embodiment of a disc projectile.
Figure 2B:
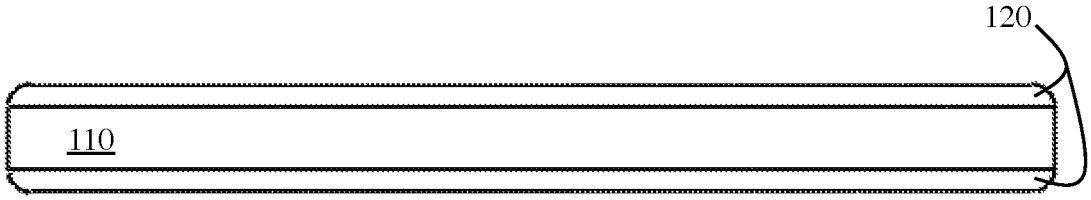
FIG. 2B is a side elevational view of the exemplary embodiment of the disc projectile.

In one embodiment, the launcher 100 launches disc projectiles made of high density foam. For example, referring to FIGS. 2A and 2B, a disc projectile 110 is illustrated in a top perspective view and a side view, respectively. The disc projectile 110 is generally round with a finite thickness and rounded circumferential corner surfaces 120. In one embodiment the disc projectile 110 is made from a material, for example a high density foam material as is known in the art, for example, having Shore 00 hardness 60 or Shore A 50 hardness. Such an exemplary hardness facilitates better transfer of rotational and translational energy to the disc projectile 110 during the firing process as is more fully described hereinbelow.

Without being held to any theory, the disc shape and the use of a high density foam in the disc projectile 110 are both contributing factors to a high level of accuracy and precision in hitting a target. There are no aerodynamic features on the disc projectile 110 other than top and bottom flat surfaces and the rounded circumferential corner surfaces 120. Therefore, the manufacturing process for the disc projectile 110 can be simplified. In one embodiment, for example without limitation, the disc projectiles 110 are manufactured by a stamping process. In another embodiment, for example without limitation, the disc projectiles 110 are manufactured by a three dimensional printing process. Other embodiment can use one or more other processes for manufacturing the disc projectiles 110 as are known in the art.

The disc projectile 110 is sufficiently soft so as to be flexible upon impact, thereby dispersing impact forces and making the disc projectiles 110 safer for the user. In one embodiment the disc projectile has a diameter of about 1.25 inches and a thickness as desired, for example without limitation, as proportionally illustrated in FIG. 2B. In other embodiments, the disc projectile 110 can have a different diameter and/or thickness to accommodate a different dimension or dimensions on the launcher or a component thereof, to change or adjust the ammunition capacity of the launcher or a component thereof, as may be beneficial or desired, or for other reasons as are known in the art.

Referring back to FIGS. 1A and 1B, the launcher 100 comprises a housing 130 that houses or otherwise supports a firing mechanism 140 (shown externally in FIGS. 1A and 1B), a magazine 150, one or more batteries or battery pack 160, a firing mode switch 170, a trigger 180, and other features, all of which are described more fully individually hereinbelow. An exemplary firing mechanism 140 is illustrated in perspective view in FIG. 3A, in a top view in FIG. 3B, and in a bottom view in FIG. 3C.

Figure 3A:
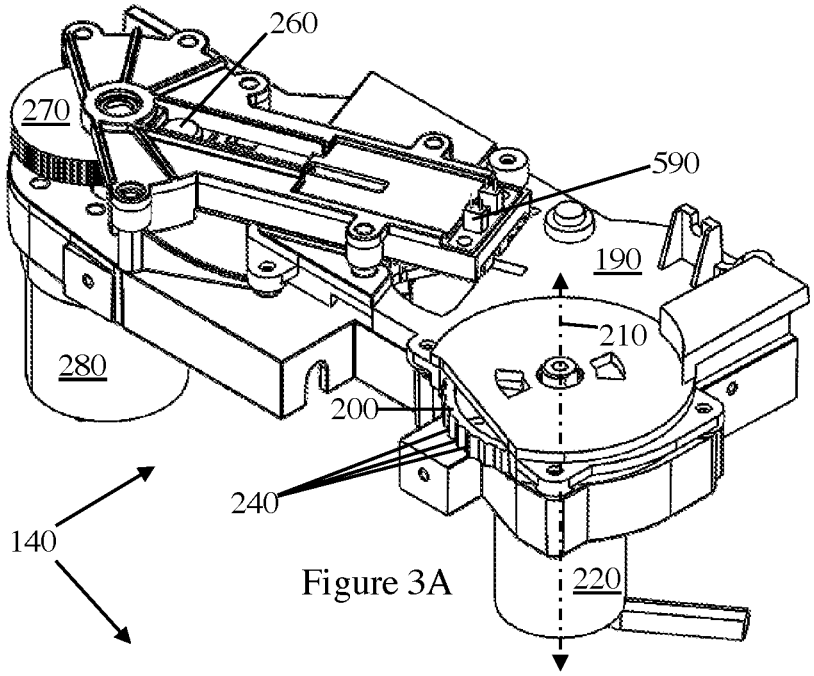
FIG. 3A is a perspective view of an exemplary embodiment of a firing mechanism that is part of the projectile launcher of FIG. 1A.
Figure 3B:
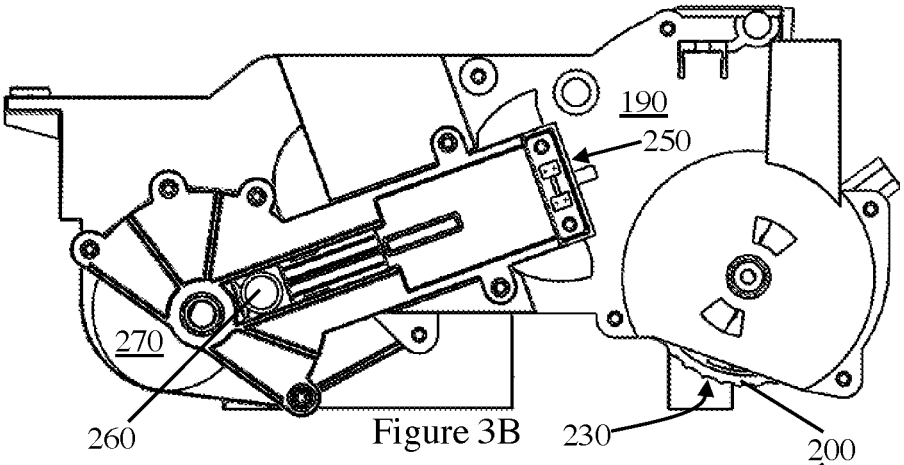
FIG. 3B is a top plan view of the firing mechanism of FIG. 3A.
Figure 3C:
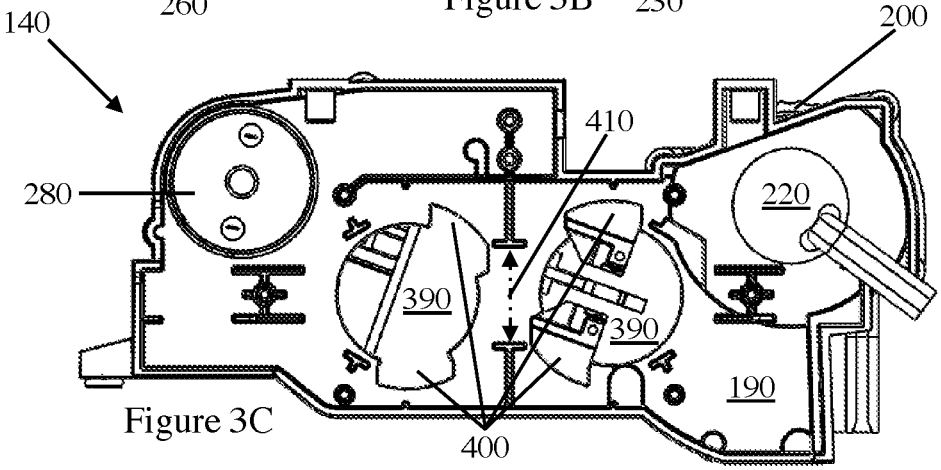
FIG. 3C is a bottom plan view of the firing mechanism of FIG. 3A.

Referring now to FIGS. 3A-3C, in one embodiment a flywheel housing 190 houses a flywheel 200 having a rotational axis 210 and driven by a first electric motor 220. In one embodiment, for example without limitation, the flywheel 200 is driven by a brushless in runner motor as is known in the art. Other embodiments utilize different types of electric motors as are known in the art. The flywheel 200 in one embodiment has a roughened circumferential edge surface 230 (see FIG. 3B), and in another embodiment the roughened circumferential edge surface 230 comprises a series of ridges 240 oriented along the rotational axis 210 (see FIG. 3A). The roughened circumferential edge surface 230 and/or ridges 240 serve to provide an enhanced frictional engagement or instantaneous attachment when coming in contact with the disc projectile 110 as is further explained hereinbelow.

The flywheel 200 in one embodiment is mounted to rotate on a bearing or bearing assembly (not illustrated) as is known in the art. Loads on the flywheel 200 are thus transferred to the bearing or bearing assembly, which enhances smooth rotation especially at high rotation speeds of the flywheel 200, and further vastly increases the life cycle expectancy for the flywheel 200, both factors contributing to the robustness and reliability of the operation of the flywheel 200. In one embodiment the first electric motor 220 drives the flywheel at a rotational speed of 24,000 revolutions per minute (rpm). In other embodiments the first electric motor 220 drives the flywheel 200 at a different rotational speed. Further, control circuitry (not shown) operationally disposed between the trigger 180 and the first motor 220 is designed to provide power from the one or more batteries or battery pack 160 to the first electric motor 220 to ramp up the flywheel 200 to full speed in about 0.2 seconds. From the standpoint of a user, such a small ramp up time is experienced to be essentially instantaneous.

The role of the flywheel 200 in operation of the launcher 100 is more fully described hereinbelow after a description of some of the other components of the flywheel housing 190. In one embodiment the flywheel 200 is made from a metal, for example without limitation aluminum. Making the flywheel 200 out of a metal like aluminum provides a hard material that it resistant to wear or other degradation, that can compress the foam of the disc projectiles 110, and that is also lightweight and can be spun up very quickly by the first electric motor 220.

Returning to FIGS. 3A-3C, the flywheel housing 190 further houses a pusher and cam assembly that includes a pusher 250 including a spring-loaded follower 260 that maintains contact with a non-circular rotating cam 270. The non-circular rotating cam 270 is rotationally driven by a second electric motor 280 (see FIGS. 3A and 3C). The spring-loaded follower 260, which is typically a roller in contact with an edge of the non-circular rotating cam 270, responds to rotation of the non-circular rotating cam 270 by reciprocating away from and back toward the axis of rotation of the cam 270. The follower 260 is mounted to the pusher 250 with a spring (not illustrated but known in the art) therebetween, thus as the follower reciprocates back and forth it moves the pusher in the same back and forth pattern while force from the spring biases the follower 260 to remain in contact with the cam 270 at all states of rotation of the cam 270.

Figure 4A:
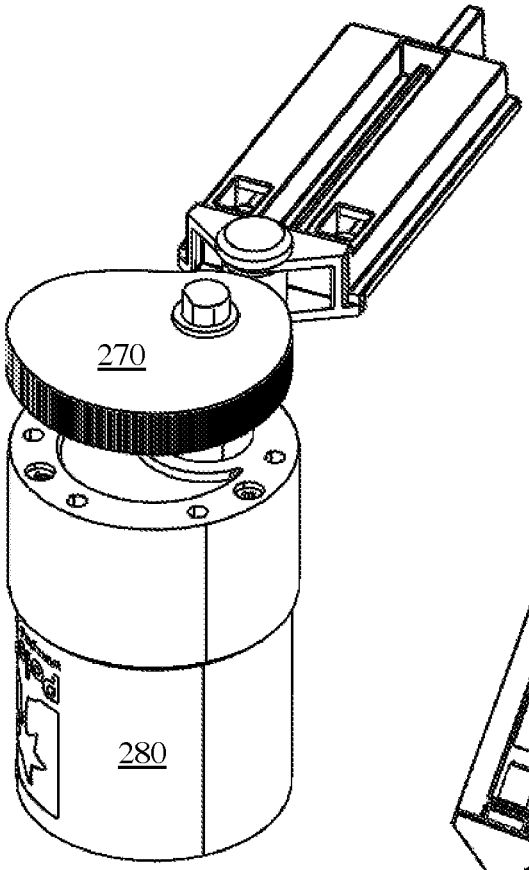
FIG. 4A is an isolated perspective view of a cam and pusher assembly that is part of the firing mechanism of FIG. 3A.
Figure 4B:
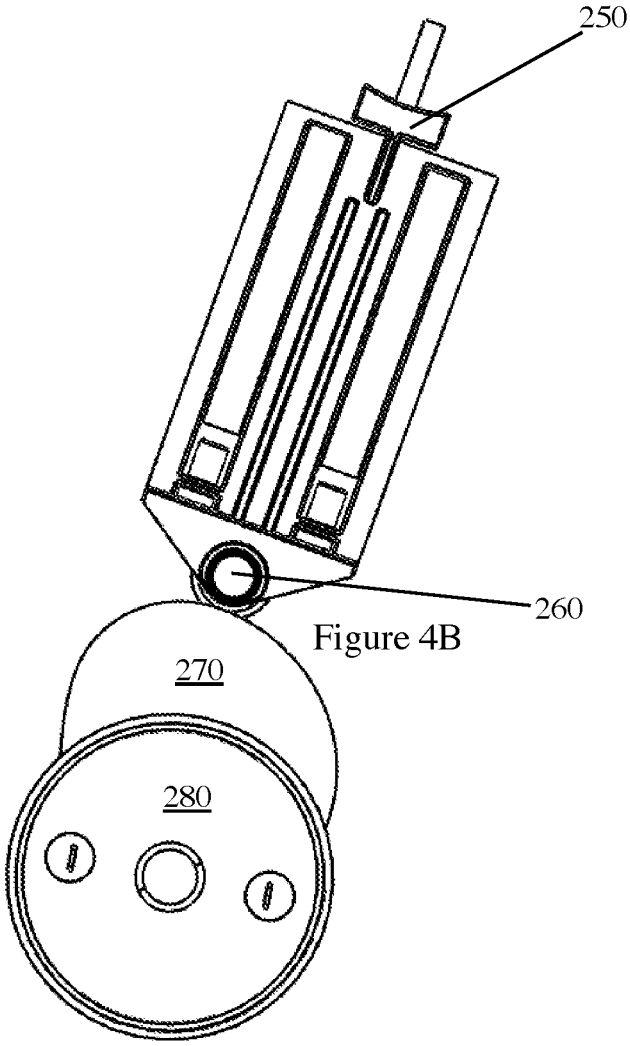
FIG. 4B is an isolated bottom plan view of the cam and pusher assembly of FIG. 4A.

Referring now to FIGS. 4A and 4B, FIG. 4A illustrates an isolated perspective view of the cam and pusher assembly showing the geometrical relationships of the pusher 250, the spring-loaded follower 260, and the non-circular rotating cam 270 that is driven by the second electric motor 280. FIG. 4B illustrates a bottom plan view of the cam and pusher assembly wherein the end of the pusher 250 that contacts the projectile discs 110 is shown to include a slightly concave surface to accommodate the convex surface of the edge of each projectile disc 110.

In one embodiment the second electric motor 280 is a gear motor as is known in the art. In other embodiments the second electric motor 280 can be chosen from other types of motors as are known in the art. In one embodiment, for example without limitation, the cam 270 is made of metal. As is explained more fully hereinbelow, to increase the firing rate of the launcher 100, the second electric motor 280 must spin at a high rate. The cam 270 can withstand greater heat and greater forces if it is made of metal rather than being made from, for example, plastic or some other material. Further, a cam 270 made from metal will not deteriorate as fast as a cam 270 made from plastic or some other material would.

In one embodiment the rotating cam 270 is mounted to rotate on a bearing or bearing assembly (not illustrated) as is known in the art. Loads on the cam 270 are thus transferred to the bearing or bearing assembly, which enhances the smooth rotation of the rotating cam 270, and further vastly increases the life cycle expectancy for the rotating cam 270, both factors contributing to the robustness and reliability of the operation of the rotating cam 270.

Figure 5A:
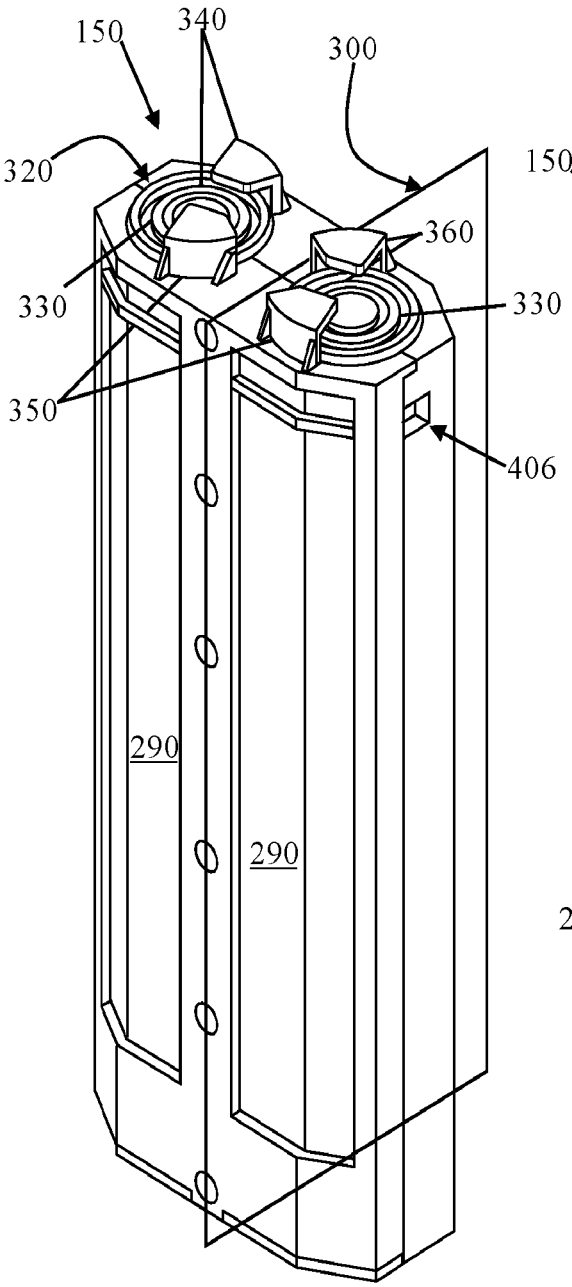
FIG. 5A is a perspective view of an exemplary magazine for use with the projectile launcher of FIG. 1A, wherein the magazine is shown in a first configuration with loading doors closed.
Figure 5B:
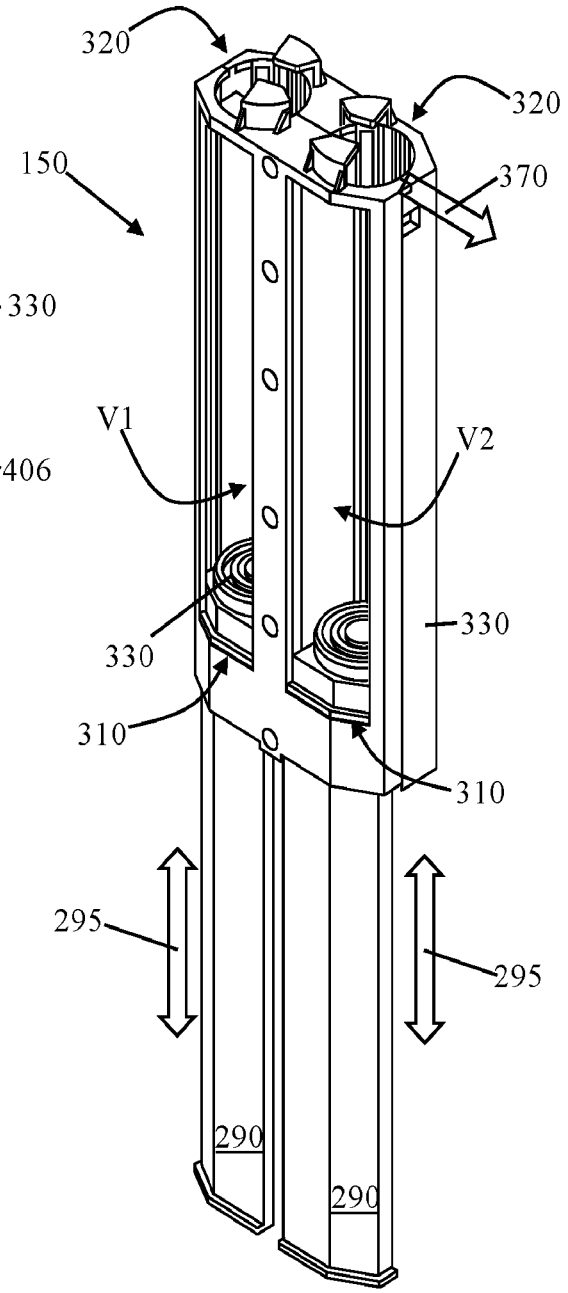
FIG. 5B is a perspective view of the magazine of FIG. 5A shown in a second configuration with the loading doors open.

Before discussing the operation of the launcher 100 there is one more component to be described in relation to the path of the projectile discs 110 through the firing mechanism 140. Referring to FIGS. 5A and 5B, the magazine 150 is illustrated in FIG. 5A isolated away from the launcher 100 and in a closed configuration. In FIG. 5B, the magazine 150 is further illustrated with a pair of sliding doors 290 both in an open configuration. The sliding doors 290 slide relative to the magazine 150 in the directions shown by arrows 295 between the closed configuration in FIG. 5A and the open configuration in FIG. 5B.

In the open configuration, the magazine 150 is seen to comprise two parallel internal volumes V1 and V2 each spaced equally from an imaginary plane 300 disposed therebetween. Each internal volume V1, V2 is configured to accommodate a stack of disc projectiles 110. Each internal volume V1, V2 is further configured to include a closed end 310 and an open end 320. A spring loaded plunger 330 is oriented within each internal volume V1, V2 to provide a biasing force on the stack disc projectiles 110 from the closed end 310 toward the open end 320. The plungers 330 are visible at the closed ends 310 of the internal volumes V1, V2 in FIG. 5B and are also visible as extending through the open ends 320 of the internal volumes V1, V2 in FIG. 5A wherein the magazine 150 is empty of disc projectiles 110.

Still referring to FIGS. 5A and 5B, the open end 320 of each internal volume V1, V2 comprises a pair of retaining tabs 340 each having a first portion 350 that extends away from the open end 320 and a second portion 360 that extends over the open end 320 so that a disc projectile 110 biased toward the open end 320 is restrained against the biasing force of the plunger 330 by the second portion 360 of the pair of retaining tabs 340, but can be pushed laterally off the stack of disc projectiles 110, for example in the direction of arrow 370. The biasing force of the plunger 330 presses the stack of disc projectiles 110 upwardly, thereby pinning them against the second portions 360 of the retaining tabs 340. During operation, whenever a disc projectile 110 is removed from the top of the stack, the plunger 330 forces the stack of disc projectiles 110 upwardly, thereby presenting another disc projectile 110 to the top of the stack until the entire stack of disc projectiles 110 is depleted. In one embodiment, the magazine 150 can hold 110 discs, 55 discs in each internal volume V1, V2.

Figure 6:
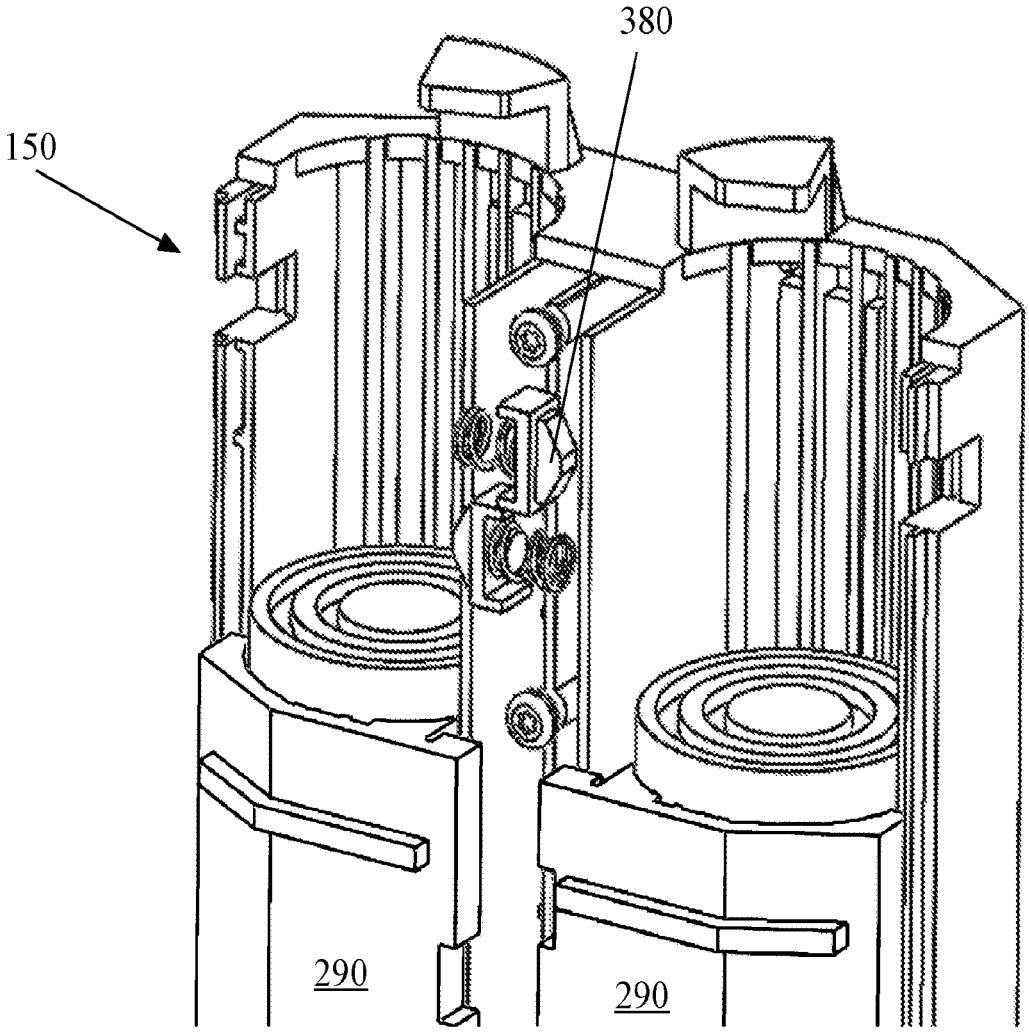
FIG. 6 is a close-up perspective view of the magazine of FIG. 5A showing detent features for the sliding doors of the magazine.

Referring briefly to FIG. 6, each of the sliding doors 290 includes detent features 380 to hold the door 290 in the fully closed position during operation of the launcher 100 and in the fully open position, for example, during filling of the magazine 150. For example, the detent feature 380 in one embodiment includes a surface having ramped top and bottom sides backed by a spring wherein the surface is biased by the spring into a notch in the door 290. Additionally, each sliding door 290 engages with and pulls along the spring loaded plunger 330 when slid from the open end 320 toward the closed end 310, for example, the sliding doors 290 each have a shoulder portion that catches on a cooperating shoulder portion of the plunger 330 as the door 290 is slid open so as to move the plunger 330 away from the open end 320 with the door 290. So when the sliding doors 290 are held in their fully open positions by detent features 380, the plungers 330 are at their bottom-most positions allowing easy access to the internal volumes V1, V2.

The magazine 150 is loaded with the projectile discs 110 primarily through the two sliding doors 290. So while it is also possible to load the disc projectiles 110 one at a time by depressing the plunger 330 or the top most projectile disc 110 at the open end 320 of an internal volume V1 or V2, and sliding a single disc projectile 110 under retaining tabs 340, it is easier and faster to load an entire stack of disc projectiles 110 simultaneously through one of the sliding doors 290 in a fully open configuration.

Referring again to FIGS. 5A and 5B, a top surface of the magazine 150 on a first side of the imaginary plane 300 has a structure that is identical to the top surface on a second side of the imaginary plane 300 but rotated 180 degrees relative thereto. Because of the 180 degree relationship of the top surfaces of the magazine 150 and the symmetry of the internal volumes V1, V2 relative to the plane 300, the magazine 150 can be removably inserted into the housing 130 in two orientations separated by 180 degrees of rotation relative to the housing 130. This capability allows the magazine 150 having the two internal volumes V1, V2 to double the available number of disc projectiles 110 deliverable to the launcher 100 without a reload operation of the magazine 150.

Returning briefly to FIG. 3C, which shows a bottom plan view of the firing mechanism 140, two generally circular holes 390 can be seen between the first and second electric motors 220 and 280. Each of the holes appears to have a pair of extensions 400 and the pairs of extensions 400 are arranged to be 180 degrees out of phase with each other across a centerline 410 disposed therebetween. Each of the extensions 400 accommodates a retaining tab 340 when the magazine is removably inserted into the flywheel housing 190.

Figure 5C:
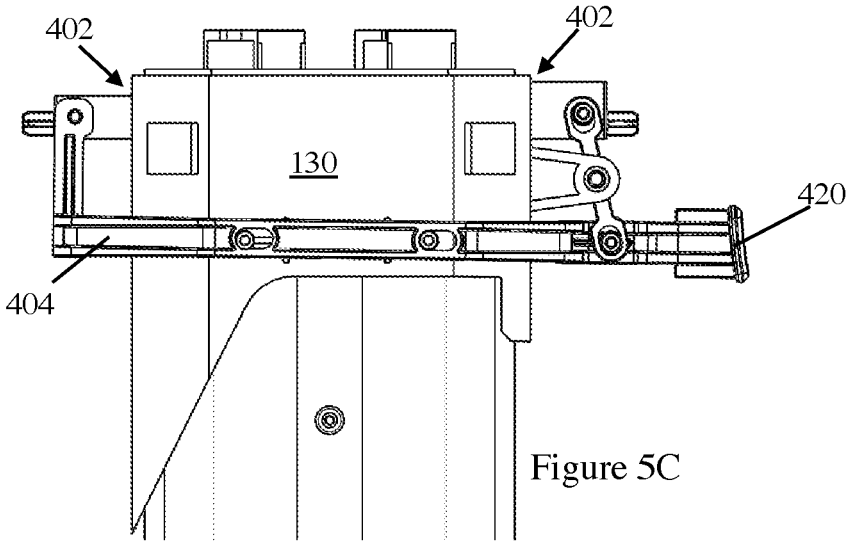
FIG. 5C is a side view of a mechanism for releasably holding the magazine when inserted into the launcher housing where the mechanism is shown in a first state.
Figure 5D:
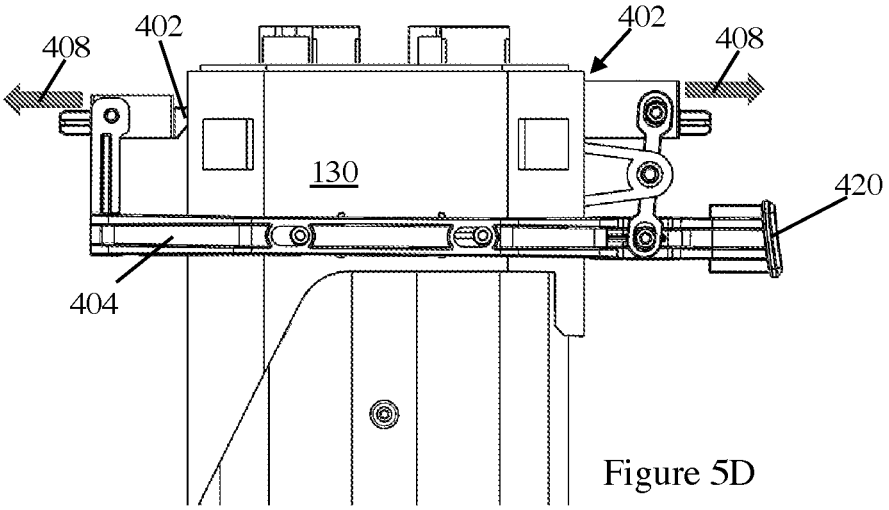
FIG. 5D is a side view of the mechanism for releasably holding the magazine when inserted into the launcher housing where the mechanism is shown in a second state.
Figure 5E:
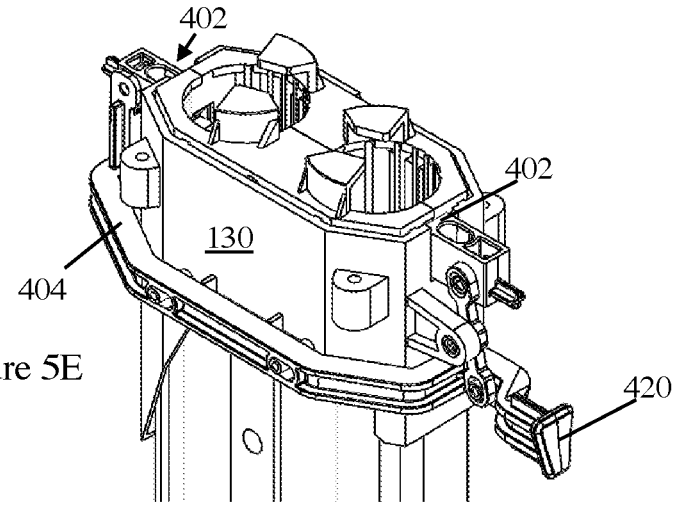
FIG. 5E is a perspective view of the mechanism for releasably holding the magazine when inserted into the launcher housing where the mechanism is shown in the first state shown in FIG. 5C.

Referring to FIGS. 5C-5E, the magazine 150 inserts into and is removably attached to the housing 130 via one or more magazine retention detents 402 that can be retracted by forcible insertion of the magazine 150 to allow the magazine 150 to be inserted and attached. However, once so attached the magazine 150 cannot be likewise forcibly removed simply by pulling on it in normal operation without breaking a portion of the magazine 150 or the housing 130. The one or more magazine retention detents 402 can only be retracted with the magazine 150 installed by depression of a magazine release button 420 (see also FIG. 1C), which is operationally connected to the one or more magazine retention detents, for example without limitation, by a mechanical linkage 404 as is known in the art.

For example, as illustrated in FIG. 5D, each of the one or more magazine retention detents 402 is mounted on the mechanical linkage 404, which is a spring loaded mechanism that is biased so that the one or more magazine retention detents 402 are forced toward one another. Each of the one or more magazine retention detents 402 has a ramped lower surface and a flat top surface and when the magazine release button 420 is not depressed the one or more magazine retention detents extend outwardly from the internal sides of the housing 130 wherein the magazine 150 gets inserted. Inserting the magazine 150 into the housing 130 first pushes the ramped lower surfaces outwardly allowing the magazine 150 to be pushed into the housing 130 until the one or more magazine retention detents 402 snap back toward each other into holes 406 disposed through sides of the magazine 150 (see FIG. 5A). FIGS. 5C and 5E show the magazine 150 so inserted and held in place with the magazine release button 420 not depressed. When the magazine release button 420 is depressed as shown in FIG. 5D, the connecting linkage 404 pushes the one or more magazine retention detents 402 away from one another as indicated by arrows 408, which removes them from the holes 406 and releases the magazine 150 to be pulled out from the housing 130.

Figures 7A, 7B:
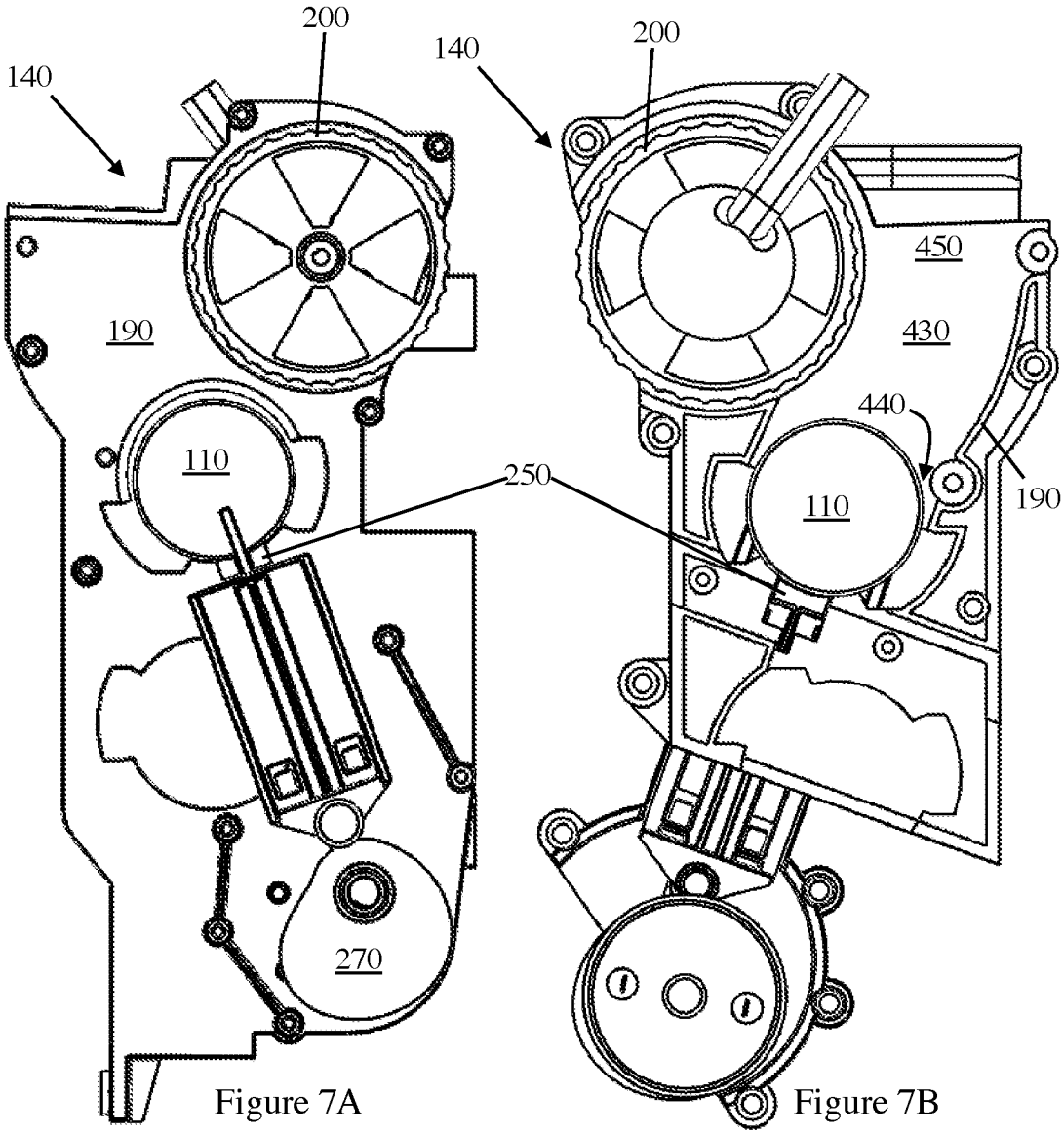
FIG. 7A is a bottom plan view of the firing mechanism of FIG. 3A shown at a first instance of time in a firing sequence.
FIG. 7B is a top plan view of the firing mechanism of FIG. 3A shown at the first instance of time in the firing sequence.

Referring now to FIGS. 7A and 7B, operation of the launcher 100 is described in detail following the path of a single disc projectile 110 through a firing sequence starting from an open end 320 of one of the internal volumes V1 or V2 of the magazine 150. FIG. 7A illustrates a top view of the firing mechanism with a disc projectile 110 disposed at the open end 320 of one of the internal volumes V1, V2 of the magazine 150. FIG. 7B illustrates a bottom view of the same time reference in the firing sequence looking through the magazine 150 (as if made transparent for this view). At this point in time the cam 270 is at a rotated position whereby the pusher 250 does not extend over the open end 320 and so has not yet pushed the disc projectile 110 laterally. FIG. 7B also shows that the flywheel housing 190 includes a passageway 430 disposed therethrough, wherein the passageway 430 comprises an entry opening 440 at a first end that is configured to receive the disc projectile 110, and a release opening 450 at a second end.

Figures 8A, 8B:
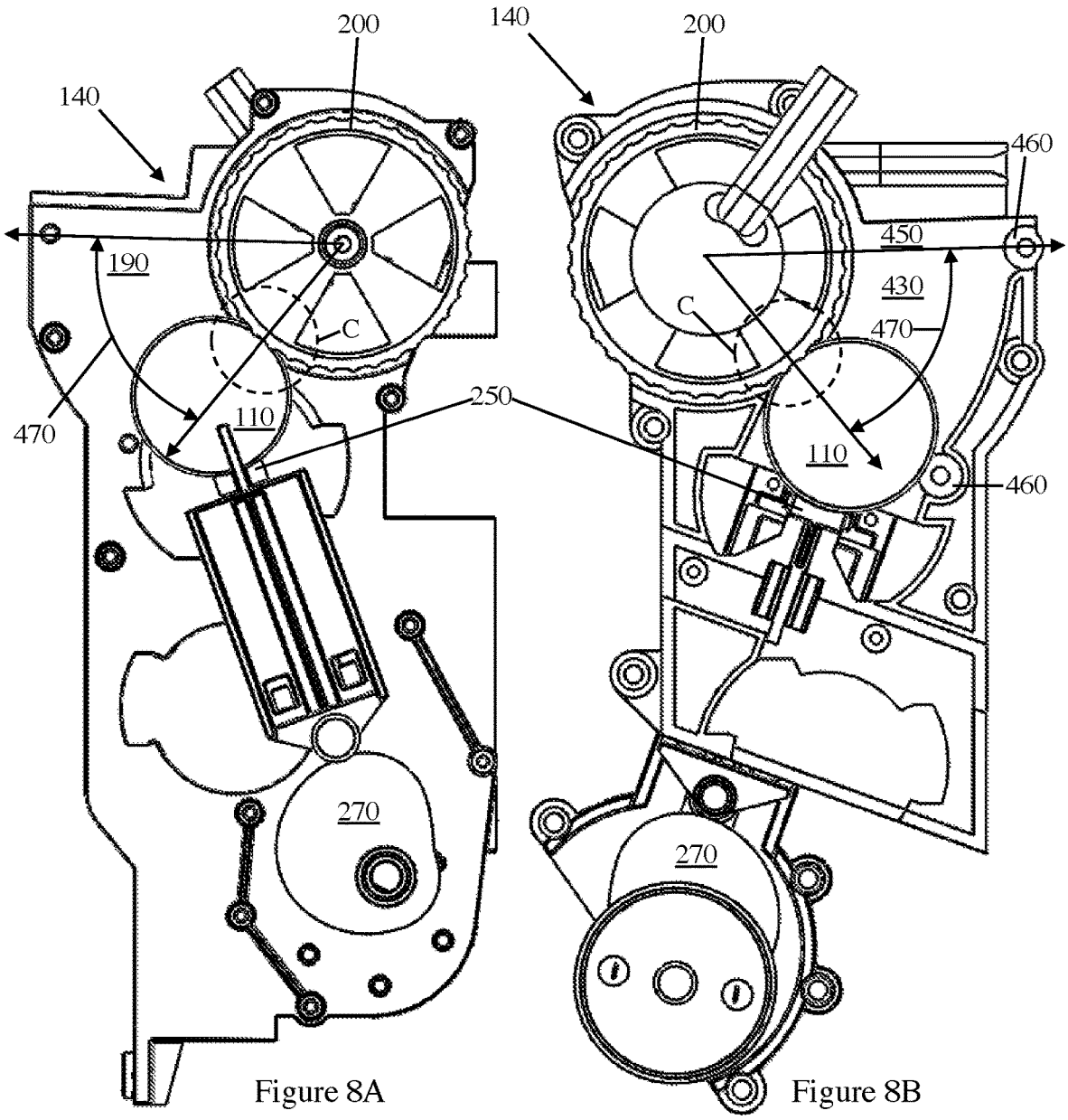
FIG. 8A is a bottom plan view of the firing mechanism of FIG. 3A shown at a second instance of time in the firing sequence when the disc projectile first contacts the flywheel.
FIG. 8B is a top plan view of the firing mechanism of FIG. 3A shown at the second instance of time in the firing sequence.

Referring now to FIGS. 8A and 8B, at a subsequent time in the firing sequence, the cam 270 has now rotated to a position whereby the pusher 250 has translated away from the rotational axis of the cam 270. The pusher 250 thus translates to push the top-most disc projectile 110 off the stack of disc projectiles 110 disposed within one of the internal volumes V1, V2 of the magazine 150 and into the firing mechanism 140. In fact, the pusher 250 pushes the disc projectile 110 into the entry opening 440 (see FIG. 7B) of the passageway 430. The flywheel housing 190 and the passageway 430 disposed therethrough are configured so that the flywheel 200 makes contact with the disc projectile 110 (as shown within the dashed circle labeled C in FIGS. 8A and 8B) when the disc projectile 110 is pushed into the entry opening 440 of the passageway 430.

It is to be noted that the disc projectile 110 is made from a material that is softer than the material of the flywheel 200. The disc projectile 110 in FIGS. 8A and 8B can be seen to be slightly compressed between the flywheel 200 and an idler bearing 460 at the entry opening 440 (see FIG. 8B). The idler bearings 460 at the entry opening 440 and at the release opening 450 of the passageway 430 allow for a consistent point of entry, point of first contact with the flywheel 200, and point of release, and further allow the disc projectile 110 to be imparted rotation from the flywheel 200 as it exits the passageway 430. Consistency in the point of release and in rotation of the disc projectile 110 is critical for accuracy and precision to the target. Upon making first contact with the flywheel 200, the disc projectile 110 is pulled by the flywheel 200 rapidly toward the release point 450. In embodiments of the flywheel 200 having a roughened circumferential edge surface 230 and/or ridges 240 disposed on the edge surface the roughened surface 230 and/or ridges 240 facilitate a better grip on the disc projectile 110.

As can be seen in FIG. 8B, the passageway 430 of the flywheel housing 190 is curved with the entry opening 440 configured to receive a disc projectile 110 at a first end, and a release opening 450 at a second end. In one embodiment, the passageway 430 has a curved geometry wherein when the disc projectile 110 is pushed into the entry opening 440 and makes first contact with the flywheel 200, the first contact occurs at an angle 470 of about 45 degrees from the release opening 450 as measured around the rotational axis 210 of the flywheel 200. Without being held to any particular theory, a curved path spanning a longer arc of contact between the flywheel 200 and the disc projectile 110 following 45 degrees of rotation of the flywheel 200 allows for a longer time of contact between the disc projectile 110 and the flywheel 200 as compared to a straight path spanning only a tangential point of contact that occurs, for example, just near the release opening 450. More energy is transferred from the spinning flywheel 200 to the disc projectile 110 by a longer contact time, which results in the disc projectile 110 being accelerated to a faster speed. A curved path spanning a 45-degree arc of contact allows for the longer contact time while still maintaining a small overall profile for the firing mechanism 140.

Figure 9A:
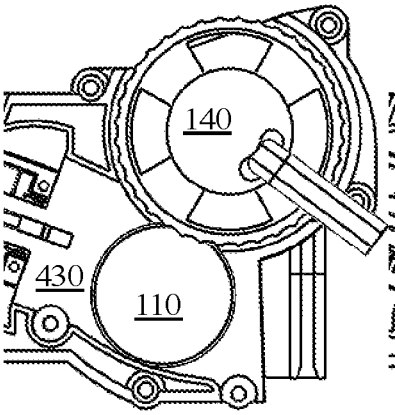
FIG. 9A is a top plan view of a portion of the firing mechanism of FIG. 3A shown at a third instance of time in the firing sequence.
Figure 9B:
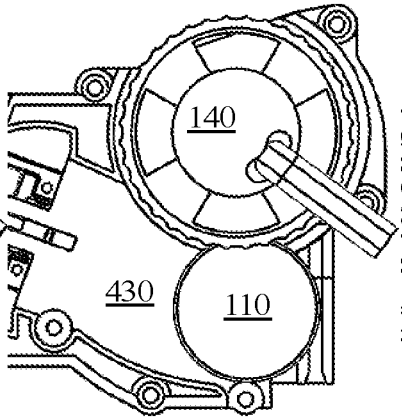
FIG. 9B is a top plan view of a portion of the firing mechanism of FIG. 3A shown at a fourth instance of time in the firing sequence.
Figure 9C:
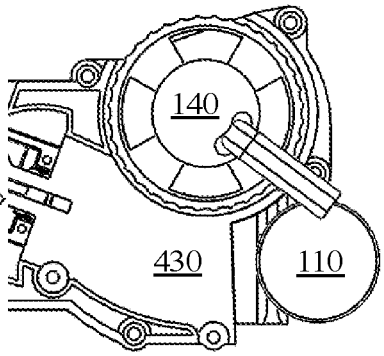
FIG. 9C is a top plan view of a portion of the firing mechanism of FIG. 3A shown at a fifth instance of time in the firing sequence.
Figure 10:
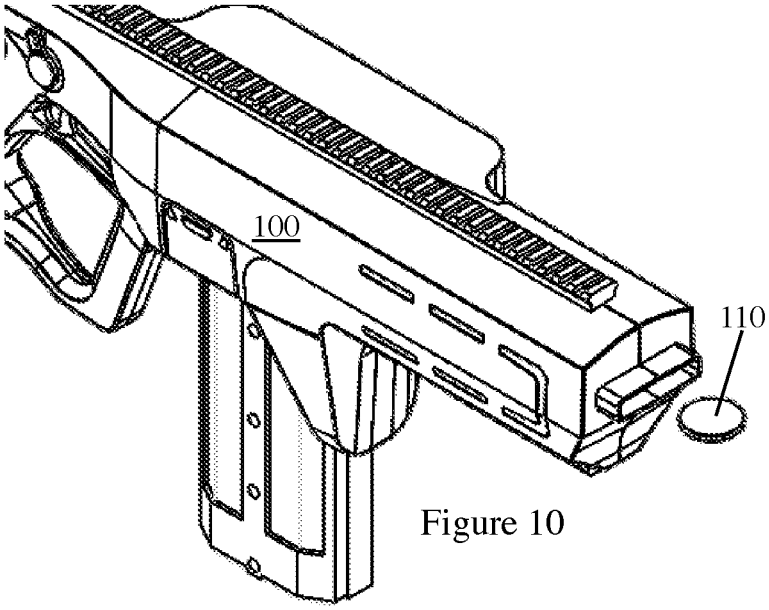
FIG. 10 is a perspective view of a disc projectile having just exited the projectile launcher.

Referring to FIGS. 9A-9C, the progress of the disc projectile 110 through the passageway 430 is illustrated for three later times in the firing sequence. FIG. 10 illustrates an external view of the disc projectile 110 having just exited the launcher 100. In one embodiment of the launcher 100, a prototype of the launcher 100 as described herein launches the disc projectiles 110 at an exit velocity of about 105 feet per second (fps). The disc projectiles 110 so launched are accurate to within about a 12 inch diameter circle of precision from a distance of about 35 feet.

Figure 11:
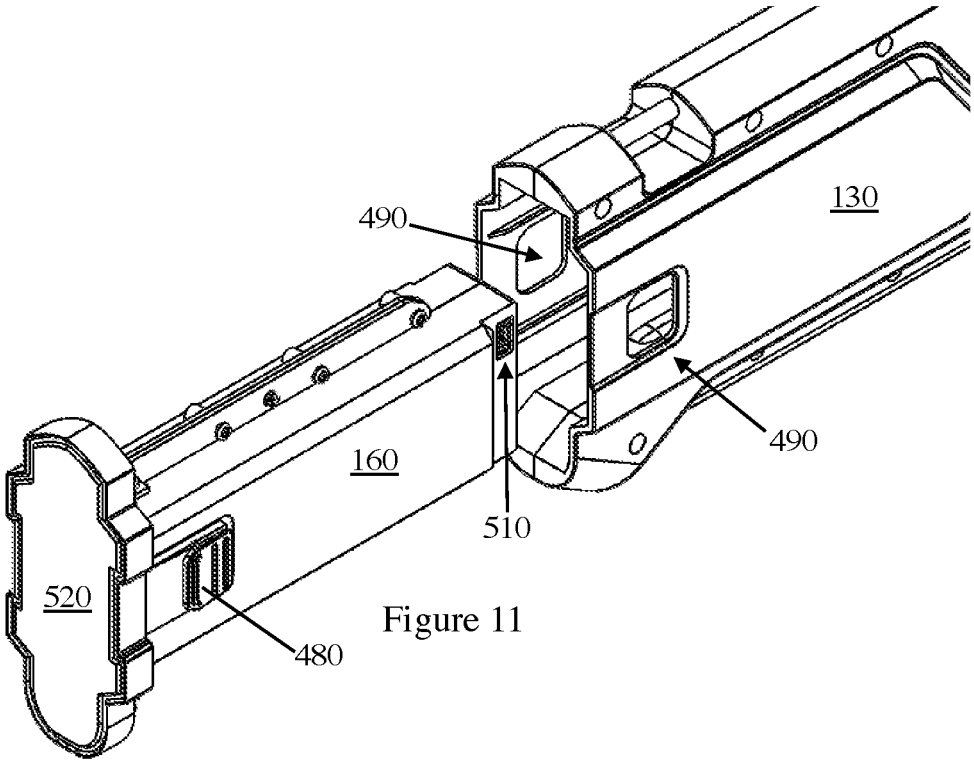
FIG. 11 is a perspective view of the one or more batteries or battery pack removed from a back end of the launcher housing.

Power for the first and second electric motors 220, 280, as well as other internal circuitry, indicators, lights, and sensors not yet described is provided by one or more batteries and/or a battery pack 160. Referring to FIG. 11, the exemplary one or more batteries or battery pack 160 is illustrated removed from the housing 130. When installed within the housing 130, an outer surface 520 of the one or more batteries or battery pack 160 defines the back end of the launcher 100.

The one or more batteries or battery pack 160 is removable from the launcher 100 via two press tabs 480, one on each side. The press tabs 480 in one embodiment are flexible tabs that have a default position that extends out further than when flexibly depressed. In another embodiment the press tabs 480 are any sort of tab that is backed by an outward biasing force provided by a leaf spring or other source of outward bias as is known in the art. When the one or more batteries or battery pack 160 is installed within the housing 130, the press tabs 480 are accommodated by the holes 490 thereby holding the one or more batteries or battery pack 160 securely in place within the housing 130. The one or more batteries or battery pack 160 is removed from the housing 130 by pressing on the press tabs 480 to depress them sufficiently through the holes 490 to allow the one or more batteries or battery pack 160 to be slid out from the housing.

Figure 12:
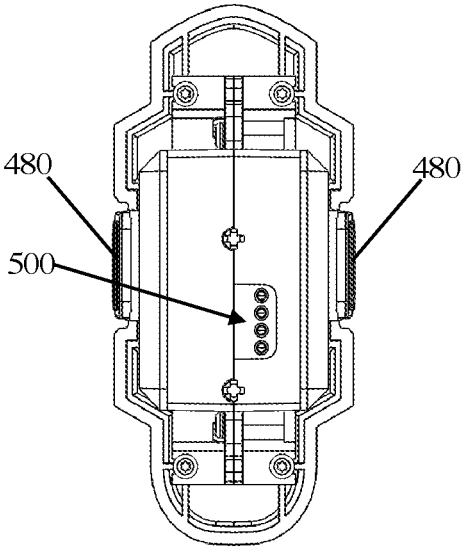
FIG. 12 is a front view of the one or more batteries or battery pack showing electrical contacts.

An internal facing surface of the one or more batteries or battery pack 160 includes contacts 500 as illustrated in FIG. 12. Upon installation of the one or more batteries or battery pack 160 into the housing 130 the contacts 500 provide electrical communication between the one or more batteries or battery pack 160 and the internal circuitry of the launcher 100 yet to be described. In one embodiment the contacts 500 can be accommodated into holes within the housing 130 or in another embodiment the contacts 500 can be spring-loaded pins, whereas in other embodiments the contacts 500 can have any structure for electrical contacts as is known in the art. The one or more batteries or battery pack 160 in one embodiment is a high-grade rechargeable Lithium-Ion polymer (LIPO) battery.

In one embodiment, the one or more batteries or battery pack 160 in one embodiment can discharge at a constant rate of 40c and a burst rate of 50c. The one or more batteries or battery pack 160 can be charged via a charge port 510, that in one embodiment is a USB port, but that in other embodiments can be any sort of charging port as is known in the art. In one embodiment, the one or more batteries or battery pack 160 provides a voltage of about 11.1 volts and has a power rating of about 6400 mAh.

Figure 13A:
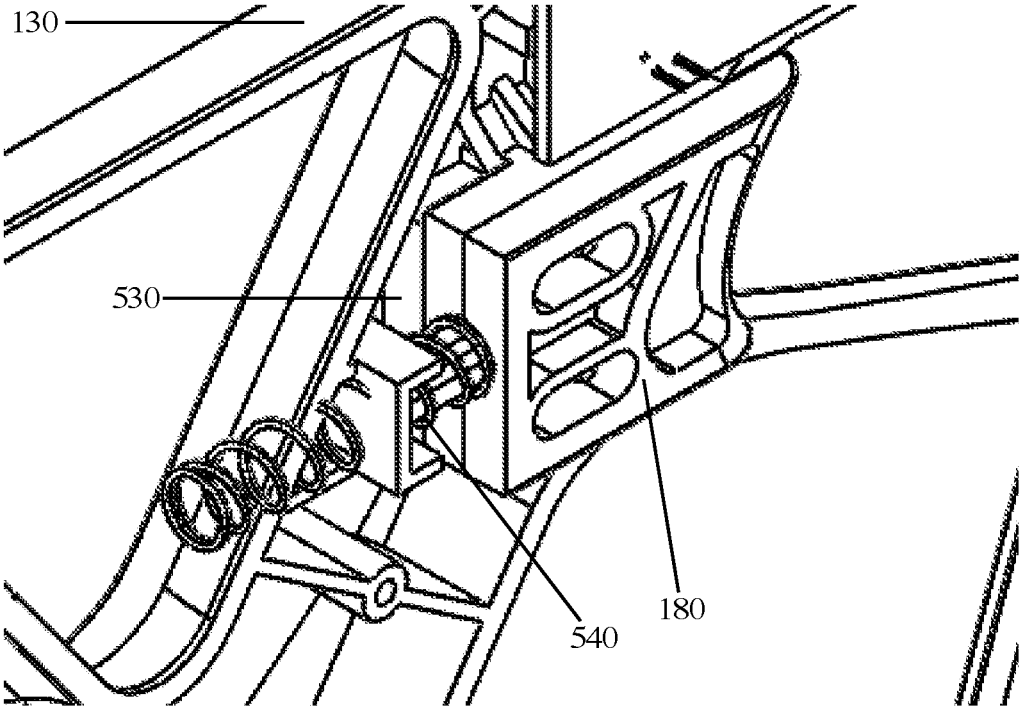
FIG. 13A is a close-up partial cutaway view of the launcher housing showing a trigger in a pressed position.
Figure 13B:
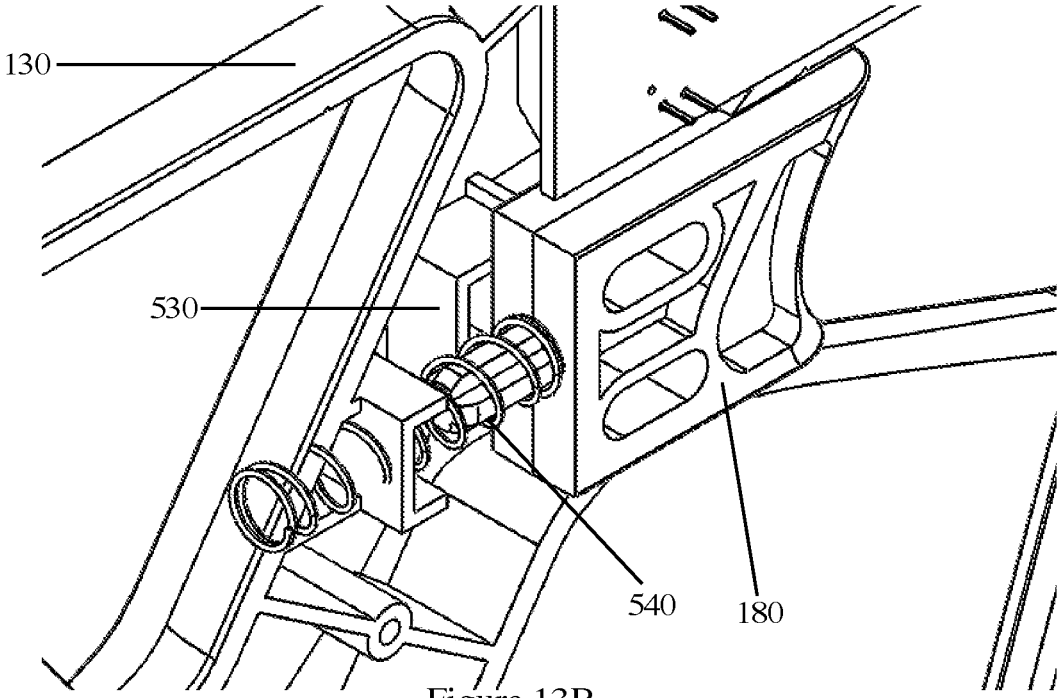
FIG. 13B is a close-up partial cutaway view of the launcher housing showing the trigger in a released position.

Referring now to FIGS. 13A and 13B, internal components associated with the trigger 180 are shown with a portion of the housing 130 effectively removed or rendered transparent. The trigger 180 is biased forward into a non-firing position by a simple biasing element 540, for example without limitation, a simple mechanical spring 540. The trigger 180 has no other mechanical linkages or controlling connections with any other components within the housing 130—it simply slides relative to the housing 130 against the force of the biasing element 540. A trigger switch 530, for example an optical sensor 530, detects whether the trigger 180 is in the pressed position shown in FIG. 13A or in the released position shown in FIG. 13B. The optical sensor 530 in one embodiment operates based on a reflected signal level that indicates the presence of the trigger 180 as a point of reflection. In other embodiments the optical sensor 530 is disposed on both sides of the trigger 180 and operates based on a transmitted or blocked signal. In other embodiments the optical sensor 530 can be any other sort of optical sensor as is known in the art. Upon detection of the trigger 180 in the pressed position the optical sensor 530 effectively closes a switch by communicating the pressed position of the trigger 180 to the internal circuitry of the launcher 100, thus the optical sensor 530 is referred to interchangeably as the trigger switch 530.

Figure 14:
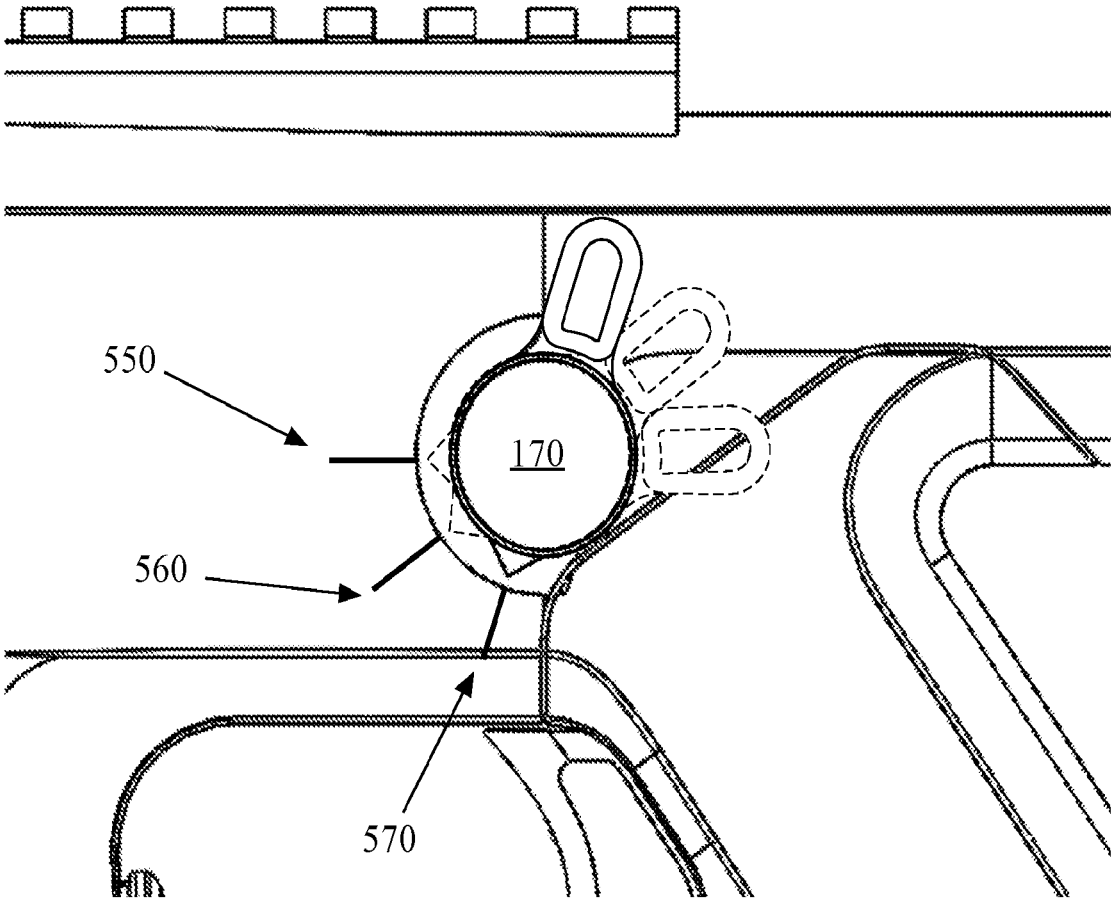
FIG. 14 is a close-up side view of the launcher showing three positions for the firing mode switch.

Referring to FIG. 14, an input to the firing sequence as defined above is the firing mode switch 170, shown in closeup view in three different positions. The firing mode switch 170 communicates with the internal circuitry of the launcher 100 and is operationally connected to the trigger switch 530 and to the pusher 250 to provide a firing mode selection that is used with the trigger 180 position to determine whether and what sort of firing sequence is initiated.

When the firing mode switch 170 is in a first position 550, the launcher 100 is in the powered-off mode so that no power is applied to either of the first or second electric motors 220, 280 regardless of the position of the trigger 180. So when the firing mode switch 170 is disposed in the powered-off position (first position 550), depression of the trigger switch has no effect on the pusher 250. When the firing mode switch 170 is in a second position 560, the launcher is in a single fire mode so that depression of the trigger 180 one time as sensed by the optical sensor 530 described hereinabove and signaled to the internal circuitry results in the internal circuitry initiating a single firing sequence including a single reciprocating cycle of the pusher 250, also as described hereinabove. In this single fire mode as denoted by switch position 560, holding the trigger in the pressed position has no additional effect beyond the initiation of a single firing sequence initiated by initial depression of the trigger 180.

Still referring to FIG. 14, when the firing mode switch 170 is in a third position 570, the launcher is in a multiple or automatic fire mode so that depression of the trigger 180 as sensed by the optical sensor 530 described hereinabove and signaled to the internal circuitry results in the internal circuitry initiating repeated firing sequences causing the pusher 250 to actuate in repeated reciprocating cycles as long as the depression of the trigger 180 is sensed by the optical sensor 530. In one embodiment, the launcher 100 in automatic fire mode can fire disc projectiles 110 at a rate of about 6.5 per second.

Figure 15A:
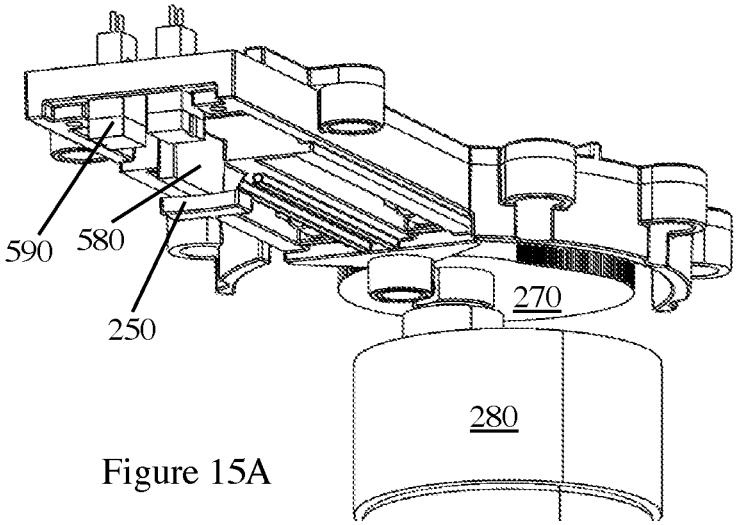
FIG. 15A is a perspective view of the cam and pusher assembly illustrating an optical sensor on the pusher portion.
Figure 15B:
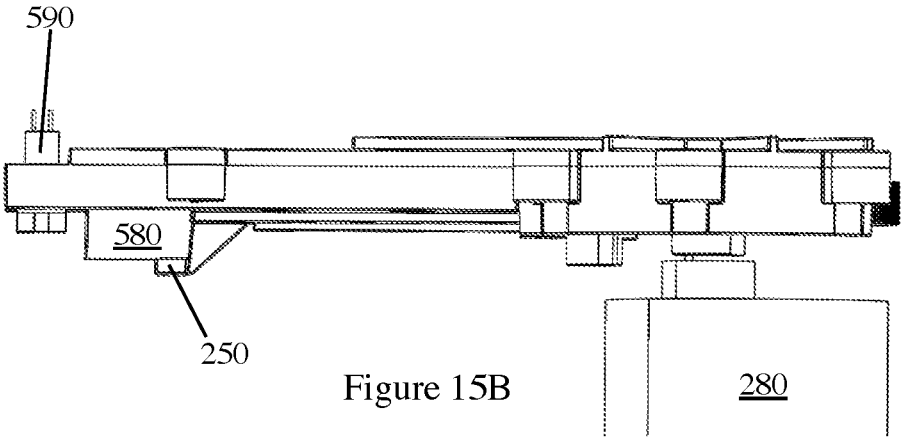
FIG. 15B is a side view of the cam and pusher assembly of FIG. 15A.

Referring now to FIGS. 15A and 15B, the pusher 250 includes a flange 580. The pusher 250 is further equipped with an optical sensor 590 (also see FIG. 3A). When the pusher 250 is in a forward position, meaning extended over one of the internal volumes V1, V2 of the magazine 150, the flange 540 breaks the plane of the optical sensor 590. However, when the pusher 250 is not in a forward position, meaning not extended over one of the internal volumes V1, V2 of the magazine 150, in a configuration as illustrated in FIGS. 15A and 15B, the plane of the optical sensor 590 is not broken by the flange 580. The optical sensor 590 communicates this information to the internal circuitry of the launcher 100, indicating to the internal circuitry that the cam 270 is in the home position which is defined as the position where the pusher 250 is clear of the retaining tabs 340. This is important because whenever the flywheel 200 is turned off either at the end of a firing sequence or after an error, the cam 270 will always rotate to the home position so that the pusher 250 is clear of the retaining tabs 340. The internal circuitry of the launcher 100 and/or the optical sensor 590 also counts the number of times that the pusher 250 has extended into the forward position. This information is useful for determining that the single fire mode firing sequence has occurred following depression of the trigger 180.

Figure 16A:
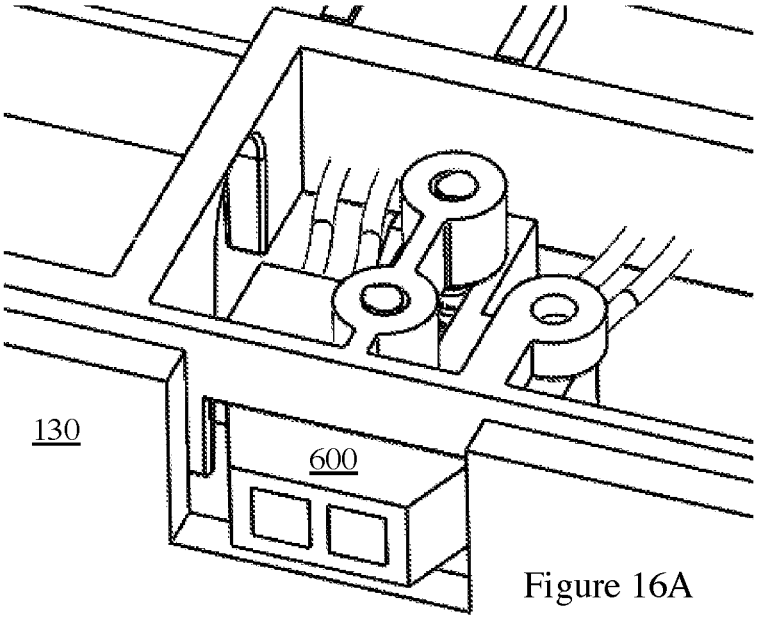
FIG. 16A is a perspective view on a portion of the housing that receives the magazine illustrating the magazine presence sensor.
Figure 16B:
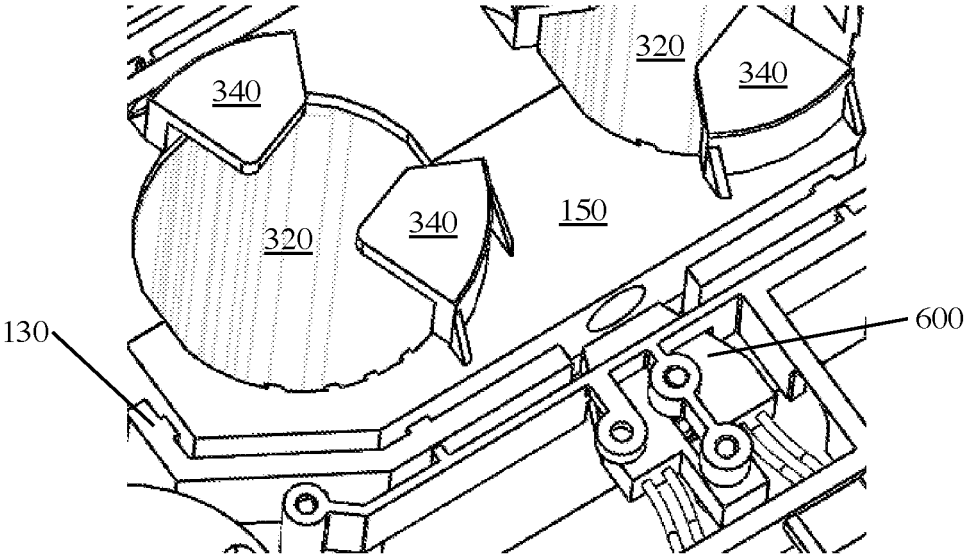
FIG. 16B is a top perspective view on the portion of the housing of FIG. 16A illustrating the magazine presence sensor with a magazine inserted.

Referring to FIGS. 16A and 16B, a magazine presence sensor 600 is illustrated. FIG. 16A illustrates an internal wall of the housing 130 where a top end of the magazine 150 would be disposed when the magazine 150 is inserted into the housing 130 as described hereinabove. FIG. 16B illustrates a view looking toward the top of the magazine 150 when so inserted. The magazine presence sensor 600 in one embodiment is an optical sensor that operates by detecting a reflected signal, for example without limitation, a time of flight (TOF) sensor. In this application the reflected signal is detected when a magazine 150 is present but no signal is detected when a magazine 150 is not present. The optical sensor 600 communicates this information to the internal circuitry of the launcher 100, indicating to the internal circuitry whether the magazine 150 is inserted into the housing 130. If the magazine 150 is not detected to be inserted the internal circuitry prevents power from being supplied to either of the first or second electric motors 220, 280. This operation prevents a user from getting entangled with any internal moving parts by accidentally pressing the trigger 180 with the magazine 150 not inserted.

In addition to the above described features of the launcher 100, the internal circuitry in one embodiment can comprise one or more printed circuit boards or other electrically connected collection of components including, for example without limitation, one or more integrated circuits, programmable integrated circuits, processors, volatile or non-volatile memories for firmware and/or software, communication ports, and any other electronic components as are known to be of use in controlling a mechanical sequence of events executed by electrically connected mechanical components as known in the art. When power is applied to the internal circuitry in one embodiment, the firmware or software stored in the one or more memories is executed by the one or more processors and controls the operation of the first and second motors 220, 280 with input from at least one or more of the sensors (530, 590, 600) and the firing mode switch 170, all described hereinabove. In one embodiment the internal circuitry is housed within the housing 130, for example without limitation, just forward of the firing mode switch 170. In other embodiments the internal circuitry is disposed elsewhere within the housing 130 or is distributed to multiple locations within the housing 130. In all embodiments the components of the electric circuitry are in electrical communication with the one or more sensors (530, 590, 600) as well as the firing mode switch 170 and any other electrical components that are included in or on the launcher 100, for example, as are further described hereinbelow.

In one embodiment, the internal circuitry described hereinabove is further in electrical communication (power and data) with a Bluetooth transceiver that allows for communication of data to or from the electrical circuitry to or from an external source. In particular, the firmware that controls operation of the launcher 100 can be accessed and upgraded or modified from an external source via the Bluetooth communication port. Therefore a launcher that is manufactured with an earlier version of the firmware can later be upgraded with a newer version of the firmware, for example without limitation, to provide for performance enhancements in terms of greater speeds of operation or enhanced modes of operation. It is also envisioned that the external source that the Bluetooth transceiver feature interfaces with can be a smart phone or tablet application, which can include for example without limitation, an application for team or individual competition involving the launcher 100.

Figure 17A:
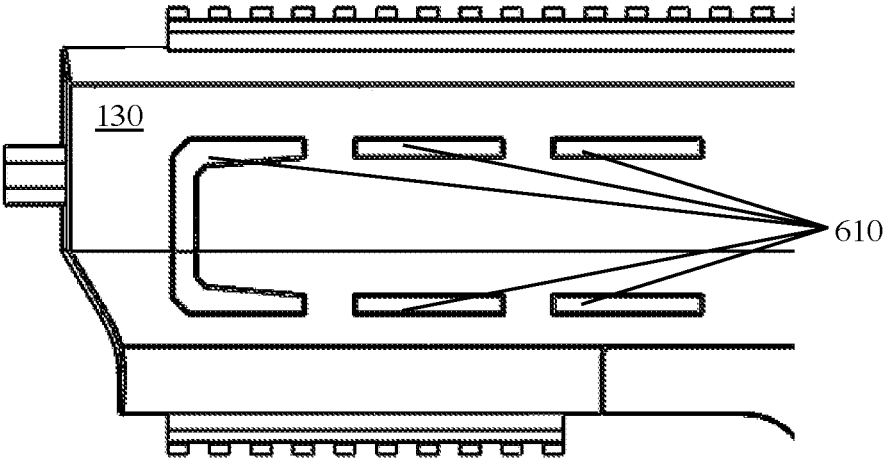
FIG. 17A illustrates several illuminating light panels disposed on a side of the launcher housing.
Figure 17B:
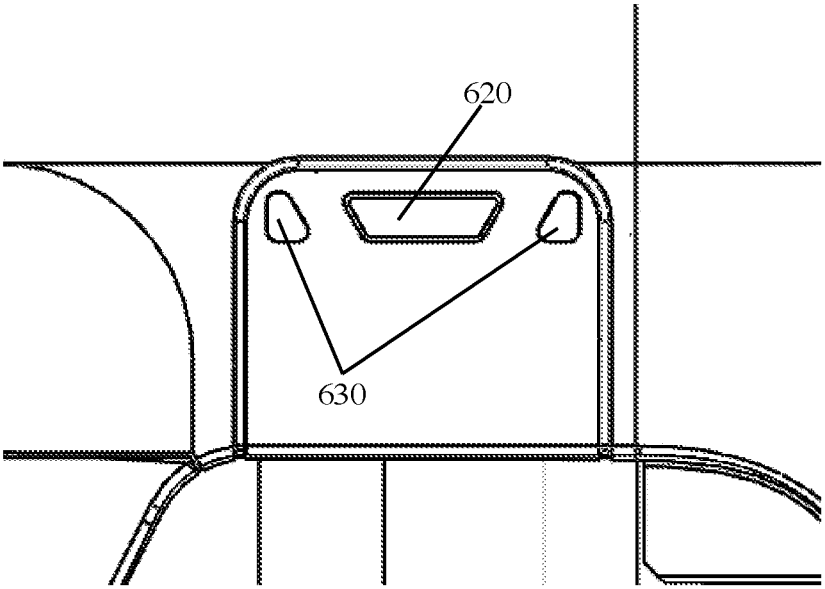
FIG. 17B illustrates a light selector button and additional illuminating light panels also disposed on a side of the launcher housing.

Another feature of the launcher 100 that is related to the concept of a team competition can be seen in FIGS. 17A and 17B. Referring to FIG. 17A, the launcher 100 includes one or more illuminating color panels or light pipes 610 distributed, for example, along sides of the housing 130 (see also FIGS. 1A and 1B). Referring to FIG. 17B, a light selector button 620 is included on a part of the housing 130, for example on a left side of the housing 130 just above the magazine 150 as shown in FIG. 1A. Additional light pipes 630 are disposed near the button 620. In one embodiment pressing the light selector button 620 cycles the light pipes 610, 630 through a series of colors allowing a user to customize their launcher 100 to have a particular color, for example, to set up a team competition where all the members of the same team have the same color illuminated. In other embodiments the illuminating light panels 610, 630 illuminate as different colors or can otherwise flash or light in a pattern or sequence. In one embodiment, where the internal circuitry is in communication with a smartphone or tablet application, the illuminating light panels can indicate a communication of data to or from the application. In one embodiment the illuminating light panels are light pipes that are supplied by light from light emitting diodes (LEDs), and in another embodiment the LEDs are digitally addressable (neopixel) LEDs that are programmable. For example, the digitally addressable LEDs could be programmed via the Bluetooth transceiver via an application on a smartphone or tablet or via other communicative software as is known in the art.

Referring again to FIGS. 1A and 1B, the launcher 100 further includes some additional physical features on the housing 130. For example, in one embodiment the launcher 100 is equipped with two sections of picatinny rails 640, an approximately 14.75-inch section across the top of the housing 130 and an approximately 3.75-inch, tactical section under the barrel. Other embodiments can have different lengths and/or different arrangements of the picatinny rails 640. The picatinny rails 640 allow a user to add several attachments to customize the launcher, for example without limitation, a scope (not shown), or a swivel swing mount (not shown). The launcher 100 is further equipped with a bar or sling mount 650 disposed on the housing 130, for example, above the one or more batteries or battery pack 160, where the sling mount 650 provides a tether or looping point for a sling to be mounted to the launcher 100.

INDUSTRIAL APPLICABILITY

A projectile launcher includes a reversible bulk-loadable magazine that can deliver solid foam disc projectiles to the launcher. The launcher operates in single fire and automatic fire modes and can fire the foam projectiles at over 100 fps and at a firing rate of over 6 projectiles per second. The launcher includes a safety lockout that restricts power to internal components when the magazine is not inserted. The launcher can further be programmed via a Bluetooth transceiver and has external lighting features that are customizable. The launcher can be made in industry for the benefit of consumers and shooting competitors.

Numerous modifications to the present invention will be apparent to those skilled in the art in view of the foregoing description. It is not desired to limit the invention to the exact construction and operation shown and described, and accordingly, all suitable modifications and equivalents may be resorted to, falling within the scope of the invention. Accordingly, this description is to be construed as illustrative only of the principles of the invention and is presented for the purpose of enabling those skilled in the art to make and use the invention and to teach the best mode of carrying out same. The exclusive rights to all modifications which come within the scope of the appended claims are reserved. All patents, patent publications and applications, and other references cited herein are incorporated by reference herein in their entirety.

We claim:

1. A projectile launcher, comprising:

a motor driven flywheel having a rotational axis and a roughened circumferential edge surface, wherein the motor driven flywheel is driven at a rotational speed of approximately 24,000 revolutions per minute; and a flywheel housing having a passageway therethrough, the passageway comprising an entry opening at a first end that is configured to receive at least one disc projectile, and a release opening at a second end; and idler bearings positioned at the entry opening and at the release opening, the idler bearings configured to provide consistent point of release and rotation of each of the at least one disc projectile wherein the launcher is configured to fire projectiles at a rate of approximately 6.5 projectiles per second in automatic firing mode.

2. The projectile launcher of claim 1, wherein the roughened circumferential edge surface comprises a series of ridges oriented along the rotational axis.

3. The projectile launcher of claim 1, further comprising a motor driven rotating cam, wherein the motor driven rotating cam and the motor driven flywheel are both mounted on bearings.

4. The projectile launcher of claim 3, wherein the motor driven rotating cam is made from a first metal, and wherein the motor driven flywheel is made from a second metal.

5. The projectile launcher of claim 1, further comprising:

the at least one disc projectile, wherein the disc projectile is made from a material that is softer than the motor driven flywheel; and wherein the flywheel housing is configured so that the motor driven flywheel makes contact with the at least one disc projectile when pushed into the entry opening.

6. The projectile launcher of claim 5, wherein the disc projectile is made from a material having Shore 00 hardness 60 and rounded circumferential corner surfaces.

7. The projectile launcher of claim 5, further comprising:

a magazine configured to provide a biasing force on the at least one disc projectile; and a pusher configured to push the at least one disc projectile out of the magazine and into the entry opening of the flywheel housing.

8. The projectile launcher of claim 7, wherein the magazine comprises two parallel internal volumes each spaced equally from a plane disposed therebetween, each internal volume including a closed end and an open end, wherein each internal volume is configured to accommodate a stack of the at least one disc projectiles, and wherein each internal volume further includes a spring loaded plunger oriented to provide the biasing force on the stack of the at least one disc projectiles from the closed end toward the open end.

9. The projectile launcher of claim 8, wherein each of the two parallel internal volumes further comprises a sliding door, wherein each sliding door has a closed position and an open position wherein the sliding door is slid away from the open end, and wherein each sliding door engages with and pulls along the spring loaded plunger when slid from the closed position toward the open position.

10. The projectile launcher of claim 8, wherein the open end of each internal volume comprises a pair of retaining tabs each having a first portion that extends away from the open end and a second portion that extends over the open end so that a single one of the at least one disc projectiles is restrained against the biasing force of the spring loaded plunger by the second portion of the pair of retaining tabs, but can be pushed off the stack of the at least one disc projectiles.

11. The projectile launcher of claim 8, wherein a top surface of the magazine on a first side of the plane has a structure that is identical to the top surface on a second side of the plane but rotated 180 degrees relative thereto.

12. A projectile launcher, comprising:

a motor driven flywheel having a rotational axis and a circumferential edge surface, wherein the motor driven flywheel is driven at a rotational speed of approximately 24,000 revolutions per minute;

a flywheel housing having a curved passageway therethrough, the curved passageway comprising an entry opening at a first end that is configured to receive at least one disc projectile, and a release opening at a second end, wherein the curved passageway spans a 45-degree arc of contact between the entry opening and release opening to provide extended contact time between the motor driven flywheel and the at least one disc projectile, resulting in increased acceleration; and idler bearings positioned at the entry opening and at the release opening, the idler bearings configured to provide consistent point of release and rotation of each of the at least one disc projectile wherein the launcher is configured to fire projectiles at a rate of approximately 6.5 projectiles per second in automatic firing mode.

13. The projectile launcher of claim 12, further comprising:

the at least one disc projectile;

a magazine configured to provide a biasing force on the at least one disc projectile; and a pusher actuated in a reciprocating cycle by a motor driven rotating cam, the pusher configured to push the at least one disc projectile out of the magazine and into the entry opening of the flywheel housing on a stroke of the reciprocating cycle; wherein the at least one disc projectile when pushed into the entry opening makes first contact with the motor driven flywheel at an angle of about 45 degrees from the release opening as measured around the rotational axis of the motor driven flywheel.

14. The projectile launcher of claim 13, further comprising:

a trigger;

a trigger switch that closes when the trigger is depressed; and a firing mode switch operationally connected to the trigger switch and to the pusher; wherein the firing mode switch is disposed in one of three positions selected from a group consisting of an off position, a single fire position, and a multiple fire position; and wherein when the firing mode switch is disposed in the off position, depressing the trigger has no effect on the pusher;

when the firing mode switch is disposed in the single fire position, depressing the trigger causes the pusher to actuate a single reciprocating cycle; and when the firing mode switch is disposed in the multiple fire position, depressing the trigger causes the pusher to actuate in the reciprocating cycle for as long as the trigger remains depressed.

15. The projectile launcher of claim 13, further comprising at least one optical safety switch operationally connected with a motor mechanically configured to drive at least one of the motor driven flywheel or the motor driven rotating cam, wherein when triggered the at least one optical safety switch operates to cut power to the motor.

16. The projectile launcher of claim 15, wherein the magazine is removably attached to the flywheel housing, and the at least one optical safety switch comprises an optical sensor configured to detect whether the magazine is attached to the flywheel housing.

17. A projectile launcher, comprising:

a firing mechanism comprising:

a motor driven flywheel having a rotational axis and a circumferential edge surface, wherein the motor driven flywheel is mounted on bearings to enhance smooth rotation and increase lifecycle expectancy, and wherein the motor driven flywheel is driven at a rotational speed of approximately 24,000 revolutions per minute; and a pusher actuated in a reciprocating cycle by a motor driven rotating cam, wherein the motor driven rotating cam is mounted on bearings to enhance smooth rotation and increase lifecycle expectancy, and wherein the motor driven rotating cam is made of metal to withstand greater heat and forces at high rotation rates; and a magazine configured to provide a biasing force on at least one stack of one or more disc projectiles; wherein the pusher is configured to push a top disc projectile off the at least one stack of one or more disc projectiles on a forward stroke of the reciprocating cycle, and the motor driven flywheel is configured to engage the top disc projectile to impart acceleration thereto; and wherein the launcher is configured to fire projectiles at a rate of approximately 6.5 projectiles per second in automatic fire mode.

18. The projectile launcher of claim 17, further comprising a housing disposed around the firing mechanism, wherein the magazine is removably inserted into the housing.

19. The projectile launcher of claim 18, wherein the housing further comprises one or more illuminating colored panels.

20. The projectile launcher of claim 18, wherein the magazine further comprises two parallel internal volumes each spaced equally from a plane disposed therebetween, each internal volume configured to accommodate one stack of the at least one stack of one or more disc projectiles, so that the magazine can be removably inserted into the housing in two orientations separated by 180 degrees of rotation relative to the housing.

* * * * *